US011066869B2

(12) United States Patent
Bai

(10) Patent No.: US 11,066,869 B2
(45) Date of Patent: Jul. 20, 2021

(54) CONNECTING DEVICE

(71) Applicant: GUANGDONG KIN LONG HARDWARE PRODUCTS CO., LTD, Dongguan (CN)

(72) Inventor: Baokun Bai, Dongguan (CN)

(73) Assignee: GUANGDONG KIN LONG HARDWARE PRODUCTS CO., LTD, Dongguan (CN)

( * ) Notice: Subject to any disclaimer, the term of this patent is extended or adjusted under 35 U.S.C. 154(b) by 0 days.

(21) Appl. No.: 15/931,263

(22) Filed: May 13, 2020

(65) Prior Publication Data

US 2021/0180394 A1 Jun. 17, 2021

(30) Foreign Application Priority Data

Dec. 11, 2019 (CN) ..... 201911268595.8

(51) Int. Cl.
*E04B 2/88* (2006.01)
*E06B 3/54* (2006.01)

(52) U.S. Cl.
CPC ..... *E06B 3/5481* (2013.01); *E04B 2/88* (2013.01)

(58) Field of Classification Search
CPC ..... E06B 3/54; E06B 3/5436; E06B 3/5481; E06B 3/5445; E04B 2/88; E04B 2/90; E04B 2/885; Y10T 403/7123
USPC ..... 52/235; 403/388
See application file for complete search history.

(56) References Cited

U.S. PATENT DOCUMENTS 5,497,586 A 3/1996 Dodd et al.
5,540,514 A 7/1996 Demars et al.
5,921,698 A * 7/1999 Hegen ..... E06B 3/5436 403/263
6,105,319 A 8/2000 Brunt
6,131,346 A 10/2000 Kordes
6,138,434 A 10/2000 Demars et al.
6,430,894 B1 * 8/2002 Chae ..... E06B 3/5436 52/786.1

(Continued)

FOREIGN PATENT DOCUMENTS

CN 2690484 Y 4/2005
CN 201180326 Y 1/2009

(Continued)

OTHER PUBLICATIONS

Chinese Office Action for Chinese Counterpart Application No. 201911268595.8, dated Dec. 18, 2020, (8 pages).

*Primary Examiner* — Ryan D Kwiecinski
(74) *Attorney, Agent, or Firm* — Kagan Binder, PLLC

(57) ABSTRACT

The present disclosure relates to a connecting device, which includes a clamping mechanism, a transverse arm mechanism, a main arm member and a connecting mechanism that are sequentially connected. The clamping mechanism includes a clamping block and a fixing member. The transverse arm mechanism includes a mounting base, a positioning member and a fastening member. The fixing member connects the clamping block and the mounting base. The positioning member is connected to one end of the mounting base away from the clamping mechanism. The fastening member connects the positioning member and the mounting base. The main arm member extends through the mounting base. The connecting mechanism is provided with a connecting rod connected to the main arm member.

9 Claims, 14 Drawing Sheets

(56) References Cited

U.S. PATENT DOCUMENTS

| | | | | |
|---|---|---|---|---|
| 6,519,903 | B1 | 2/2003 | Dirisamer et al. | |
| 6,796,091 | B2 | 9/2004 | Elmer | |
| 7,571,575 | B2 | 8/2009 | Ernewein et al. | |
| 7,603,820 | B1 * | 10/2009 | Lai | E06B 3/5436 403/56 |
| 7,913,464 | B2 | 3/2011 | Eckelt et al. | |
| 8,245,465 | B2 | 8/2012 | Bai | |
| 8,806,818 | B2 * | 8/2014 | Morgan | E04B 2/96 52/204.62 |
| 10,301,815 | B2 | 5/2019 | Bai | |
| 2001/0000274 | A1 | 4/2001 | Elmer et al. | |
| 2001/0023562 | A1 | 9/2001 | Blobaum et al. | |
| 2008/0005983 | A1 | 1/2008 | Lin | |
| 2008/0010921 | A1 | 1/2008 | Lin | |
| 2008/0196335 | A1 * | 8/2008 | Lin | E06B 3/5436 52/235 |
| 2009/0249736 | A1 | 10/2009 | Bai | |
| 2011/0023391 | A1 | 2/2011 | Clair et al. | |
| 2013/0284878 | A1 * | 10/2013 | Wellershoff | F16M 13/02 248/548 |
| 2016/0017596 | A1 | 1/2016 | Ballesteros et al. | |

FOREIGN PATENT DOCUMENTS

| | | | | | |
|---|---|---|---|---|---|
| CN | 201502118 | U | | 6/2010 | |
| CN | 201785908 | U | | 4/2011 | |
| CN | 202324273 | U | | 7/2012 | |
| CN | 202390967 | U | | 8/2012 | |
| CN | 103883049 | A | | 6/2014 | |
| CN | 204385994 | U | | 6/2015 | |
| CN | 207177004 | U | | 4/2018 | |
| CN | 209293253 | U | | 8/2019 | |
| CN | 211735963 | U | | 10/2020 | |
| DE | 2134167 | C3 | | 6/1975 | |
| DE | 19915195 | C1 | * | 11/2000 | E06B 3/5436 |
| DE | 20115867 | U1 | * | 2/2002 | E06B 3/5436 |
| DE | 20022393 | U1 | | 3/2002 | |
| DE | 10302296 | A1 | * | 7/2004 | E06B 3/5436 |
| EP | 0931943 | A2 | | 7/1999 | |
| EP | 0965721 | A1 | | 12/1999 | |
| EP | 1243739 | A1 | * | 9/2002 | E06B 3/5436 |
| KR | 200415840 | Y1 | | 5/2006 | |
| KR | 2014135574 | A | * | 11/2014 | |
| WO | WO-9934082 | A1 | * | 7/1999 | E06B 3/5436 |
| WO | WO-2004015234 | A1 | * | 2/2004 | E06B 3/5436 |

* cited by examiner

CONNECTING DEVICE

CROSS REFERENCE TO RELATED APPLICATION

This application claims the benefit of Chinese Patent Application No. 201911268595.8, filed on Dec. 11, 2019, the entire content of which is incorporated herein in its entirety.

TECHNICAL FIELD

The present disclosure relates to a technical field of glass fixing apparatus, in particular, to a connecting device.

BACKGROUND

With the continuous development of point supported glass curtain walls, its application fields and scope continue to expand, and different geographical environments have put forward higher requirements for the stability of point supported glass curtain walls to ensure the safety of people's lives and property and create a living environment with safety and comfort. Since coastal cities and areas with relatively active earthquakes have a higher chance of hurricanes and strong earthquakes, these areas require higher stability of point supported connecting systems. However, most point supported connecting member in the current market generally cannot effectively resist hurricanes, strong earthquakes and the like.

SUMMARY

Accordingly, it is necessary to provide a connecting device having a simple structure and being convenient to use to address the above problems.

A connecting device includes a clamping mechanism, a transverse arm mechanism, a main arm member and a connecting mechanism that are sequentially connected. The clamping mechanism includes a clamping block and a fixing member. The transverse arm mechanism includes a mounting base, a positioning member and a fastening member. The fixing member connects the clamping block and the mounting base. The positioning member is connected to one end of the mounting base away from the clamping mechanism. The fastening member connects the positioning member and the mounting base. The main arm member extends through the mounting base. The connecting mechanism is provided with a connecting rod connected to the main arm member.

According to the connecting device of the present disclosure, the clamping block, the mounting base, the main arm member, and the connecting rod are connected as a whole, and the clamping block clamps the glass, the connecting rod is connected to building structural parts, thus, the self-weight, wind load, earthquake load and the like of the glass can be transmitted to the building structural parts. The connecting device of the present disclosure has a simple structure and is convenient to use. It can ensure the stability of the curtain wall system and improve the safety performance of the curtain wall system under the strong loads such as hurricanes and earthquakes.

In one of the embodiments, the main arm member includes a latching portion, a guiding portion and a limiting portion that are sequentially connected. The latching portion protrudes from the guiding portion. The guiding portion is slidably arranged in the mounting base. The limiting portion is connected to the connecting rod.

In one of the embodiments, a width of a cross-section of the limiting portion gradually increases from one end thereof adjacent to the guiding portion to the other end thereof.

In one of the embodiments, the main arm member further includes a convex block protruding from the guiding portion.

In one of the embodiments, the clamping block includes a first clamping portion, a second clamping portion, and a connecting portion connecting the first clamping portion and the second clamping portion. The first clamping portion cooperates with the second clamping portion to clamp the glass.

In one of the embodiments, the clamping mechanism further includes an abutting block, and a first elastic member and a second elastic member that are sleeved on an end of the fixing member away from the clamping block. Both sides of the abutting block abut against the first elastic member and the second elastic member, respectively.

A connecting device includes a clamping mechanism, a transverse arm mechanism, a main arm member and a connecting mechanism that are sequentially connected. The clamping mechanism includes a clamping block and a fixing member. The transverse arm mechanism includes a mounting base and a fastening member. The fixing member connects the clamping block and the mounting base. The main arm member extends through the mounting base. The fastening member connects the main arm member and the mounting base. The connecting mechanism is provided with a connecting rod connected to the main arm member.

In one of the embodiments, the clamping mechanism further includes an abutting block, and a first elastic member and a second elastic member that are sleeved on an end of the fixing member away from the clamping block. Both sides of the abutting block abut against the first elastic member and the second elastic member, respectively.

In one of the embodiments, the main arm member includes a guiding portion and a limiting portion that are sequentially connected. The guiding portion is slidably arranged in the mounting base. The limiting portion is connected to the connecting rod.

In one of the embodiments, the main arm member further includes a convex block protruding from the guiding portion.

REFERENCE NUMERALS LIST

Figure 1:
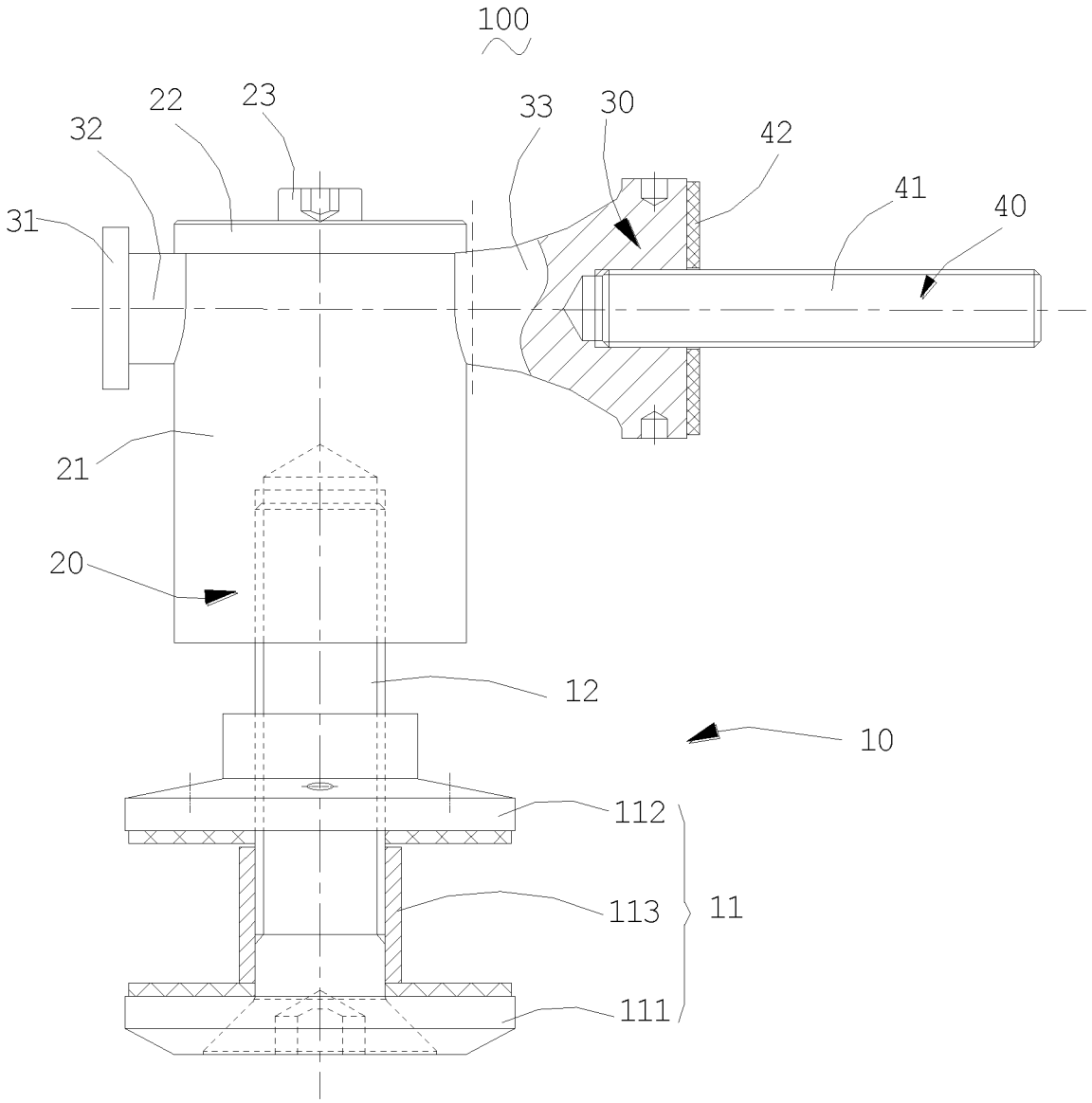
FIG. 1 is a structural schematic view of an assembled state of a connecting device according to a first embodiment of the present disclosure.

100—connecting device, 10—clamping mechanism, 11—clamping block, 111—first clamping portion, 112—second clamping portion, 113—connecting portion, 12—fixing member, 20—transverse arm mechanism, 21—mounting base, 210—receiving groove, 22—positioning member, 23—fastening member, 30—main arm member, 31—latching portion, 32—guiding portion, 33—limiting portion, 40—connecting mechanism, 41—connecting rod, 42—buffer member, 43—sleeve, 30*a*—main arm member, 32*a*—guiding portion, 34*a*—convex block, 10*b*—clamping mechanism, 11*b*—clamping block, 12*b*—fixing member, 13*b*—abutting block, 14*b*—first elastic member, 15*b*—second elastic member, 20*b*—transverse arm mechanism, 21*b*—mounting base, 22*b*—positioning member, 24*b*—fixing base, 100*c*—connecting device, 20*c*—transverse arm mechanism, 21*c*—mounting base, 210*c*—through hole, 23*c*—fastening member, 30*c*—main arm member, 32*c*—guiding portion, 33*c*—limiting portion, 30*d*—main arm member, 32*d*—guiding portion, 34*d*—convex block, 10*e*—clamping mechanism, 11*e*—clamping block, 12*e*—fixing member, 13*e*—abutting block, 14*e*—first elastic member, 15*e*—second elastic member, 20*e*—transverse arm mechanism, 21*e*—mounting base, 210*e*—through hole, 24*e*—fixing base.

DETAILED DESCRIPTION OF THE EMBODIMENTS

For the convenience of understanding of the present disclosure, the present disclosure will be more fully described. However, the present disclosure can be implemented in many different forms and is not limited to the embodiments described herein. In contrast, the purpose of providing these embodiments is to providing a fully and thoroughly understanding of the disclosure of the present disclosure.

Unless defined otherwise, all technological and scientific terms used herein have the same meaning as commonly understood by one of those skilled in the art to which present disclosure belongs. The terms used herein in the specification of the present disclosure are only for describing specific embodiments, and are not intended to limit the present disclosure.

Embodiment 1

Referring to FIGS. 1 to 4, a connecting device 100 according to an embodiment of the present disclosure includes a clamping mechanism 10, a transverse arm mechanism 20, a main arm member 30, and a connecting mechanism 40 that are sequentially connected. According to the connecting device 100 of the present disclosure, the clamping mechanism 10, the transverse arm mechanism 20, the main arm member 30, and the connecting mechanism 40 are connected as a whole, and the clamping mechanism 10 clamps glass, the connecting mechanism 40 is connected to building structural parts, thus, the self-weight, wind load, earthquake load and the like of the glass can be transmitted to the building structural parts.

Figure 2:
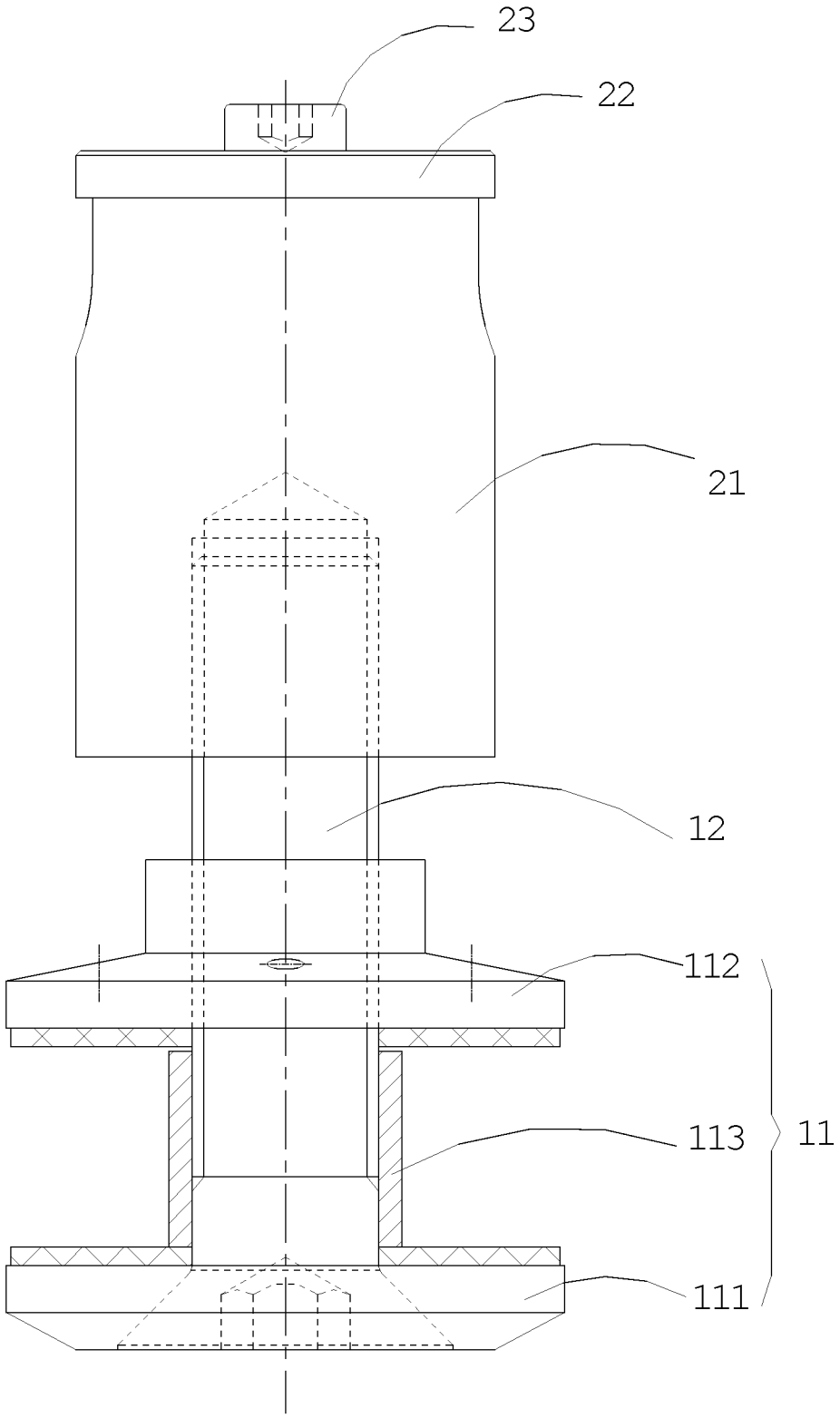
FIG. 2 is a structural schematic view of a clamping mechanism and a transverse arm mechanism in the connecting device as shown in FIG. 1.

As shown in FIGS. 1 and 2, in this embodiment, the clamping mechanism 10 includes a clamping block 11 for clamping the glass and a fixing member 12. Optionally, the clamping block 11 includes a first clamping portion 111, a second clamping portion 112, and a connecting portion 113 connecting the first clamping portion 111 and the second clamping portion 112. The first clamping portion 111 cooperates with the second clamping portion 112 to clamp the glass. The fixing member 12 is a screw.

Figure 3:
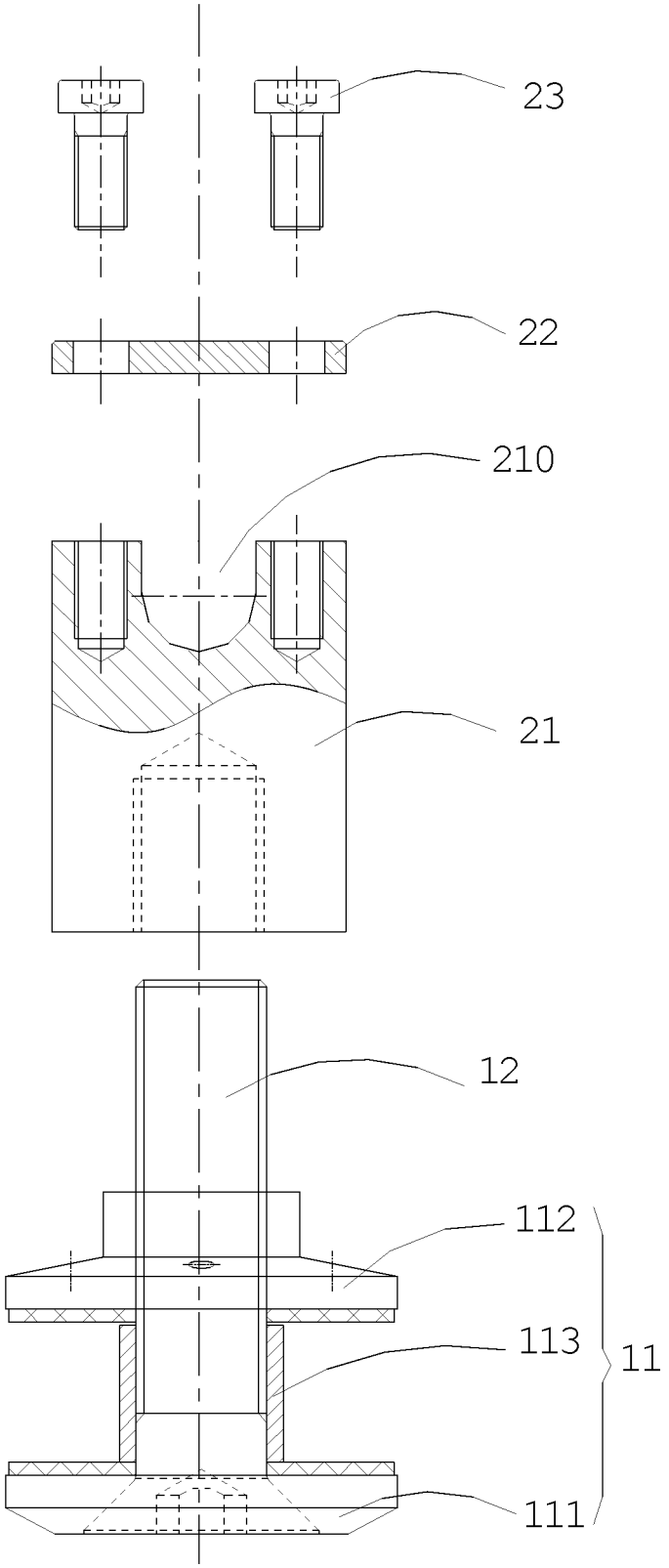
FIG. 3 is an exploded view of the clamping mechanism and the transverse arm mechanism in the connecting device as shown in FIG. 2.

As shown in FIG. 3, the transverse arm mechanism 20 includes a mounting base 21, a positioning member 22, and a fastening member 23. The fixing member 12 connects the clamping block 11 and the mounting base 21. The positioning member 22 is connected to one end of the mounting base 21 away from the clamping mechanism 10. The fastening member 23 is configured to connect the positioning member 22 and the mounting base 21. Optionally, the mounting base 21 is provided with a receiving groove 210. The fastening member 23 is a bolt. Further, the receiving groove 210 is a U-shaped groove. The fixing member 12 is threadedly connected to the mounting base 21, and the fastening member 23 is threadedly connected to the mounting based 21.

Figure 4:
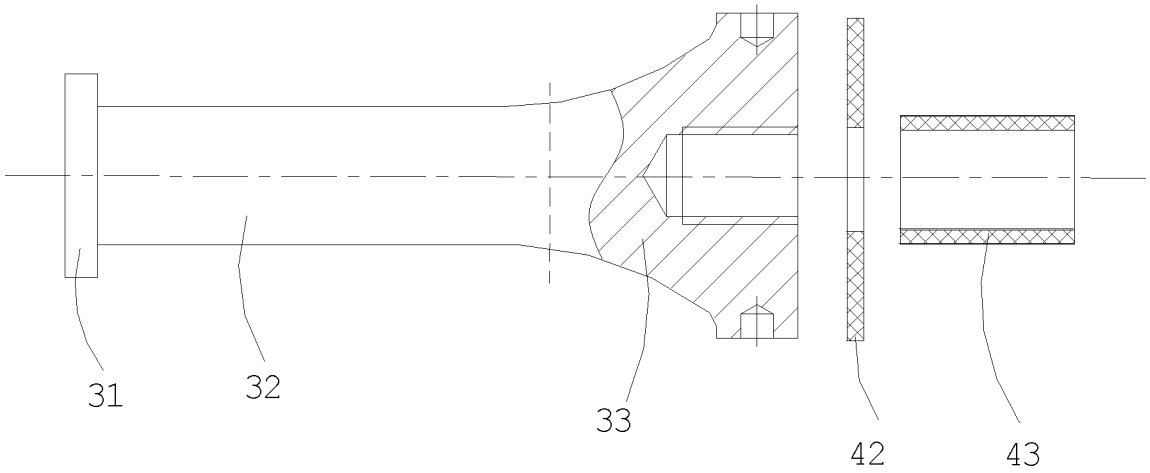
FIG. 4 is an exploded view of the transverse arm mechanism and a connecting mechanism in the connecting device as shown in FIG. 1.

As shown in FIG. 4, the main arm member 30 extends through the mounting base 21. The main arm member 30 includes a latching portion 31, a guiding portion 32, and a limiting portion 33 that are sequentially connected. The latching portion 31 protrudes from the guiding portion 32. The guiding portion 32 is slidably arranged in the mounting base 21. Optionally, the guiding portion 32 is a straight rod, and a width of the cross-section of the limiting portion 33 gradually increases from one end thereof adjacent to the guiding portion 32 to the other end thereof. Moreover, the size of the latching portion 31 is larger than the size of the receiving groove 210 of the mounting base 21, the largest width of the cross-section of the limiting portion 33 is larger than the size of the receiving groove 210, so as to stop the main arm member 30 in the mounting base 21.

In an embodiment, the connecting mechanism 40 is provided with a connecting rod 41. The connecting rod 41 is connected to the building structural parts. The connecting rod 41 is connected to the limiting portion 33 of the main arm member 30. Optionally, the connecting rod 41 is threadedly connected to the limiting portion 33. The connecting rod 41 is a screw. In order to protect the supporting structure body of the curtain wall, such as glass ribs, the connecting mechanism 40 further includes a buffer member 42. The buffer member 42 is connected to one end of the main arm member 30. The connecting rod 41 extends through the buffer member 42. Moreover, the connecting mechanism 40 further includes a sleeve 43. The sleeving 43 is connected to an outside of the buffer member 42. The sleeve 43 is sleeved on the connecting rod 41. In use, the guiding portion 32 is provided in the receiving groove 210 of the mounting base 21, and the positioning member 22 and the mounting base 21 are fixed by the fastening member 23.

In use, the clamping block 11 clamps the glass. The guiding portion 32 is provided in the receiving groove 210 of the mounting base 21, and the positioning member 22 and the mounting base 21 are fixed by the fastening member 23. The connecting rod 41 is connected to the building structural parts. Therefore, the self-weight, wind load, earthquake load and the like of the glass can be transmitted to the building structural parts, so that the stability of the curtain wall system can still be ensured under the irresistible factors such as hurricanes and strong earthquakes.

According to the connecting device 100 of the present disclosure, the clamping block 11, the mounting base 21, the main arm member 30, and the connecting rod 41 are connected as a whole, and the clamping block 11 clamps the glass, the connecting rod 41 is connected to the building structural parts, thus, the self-weight, wind load, earthquake load and the like of the glass can be transmitted to the building structural parts. The connecting device 100 according to the present disclosure has a simple structure and is convenient to use. It can ensure the stability of the curtain wall system and improve the safety performance of the curtain wall system under the strong loads such as hurricanes and earthquakes.

Embodiment 2

Figure 5:
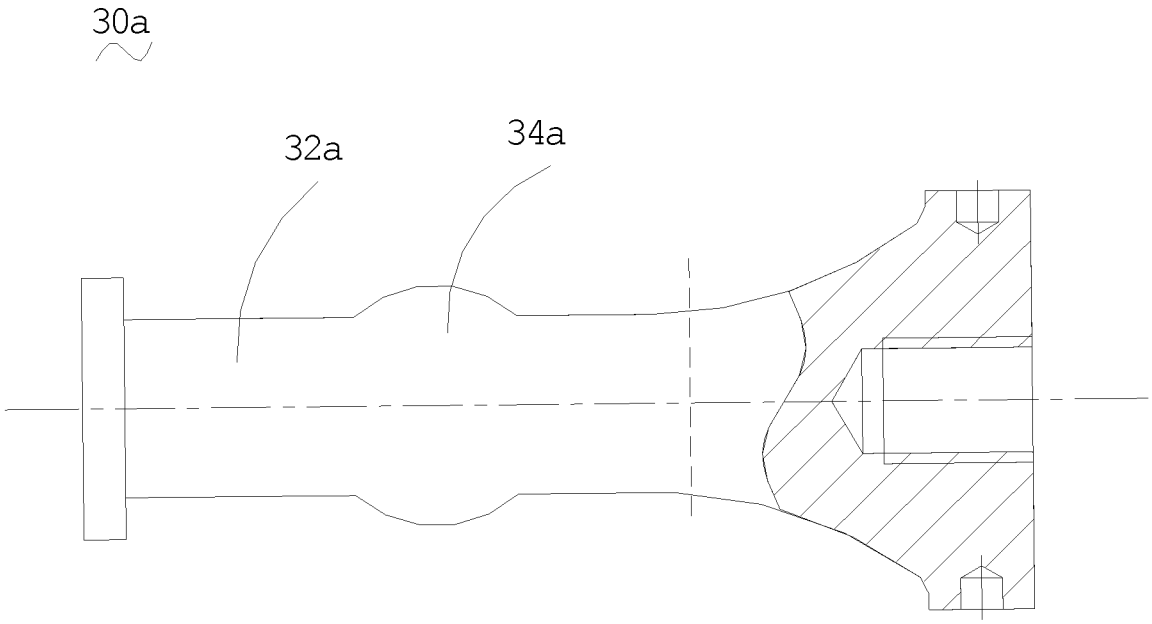
FIG. 5 is a structural schematic view of a min arm member in a connecting device according to a second embodiment of the present disclosure.

Referring to FIG. 5, it shows a main arm member 30*a* of a connecting device according to a second embodiment of the present disclosure. The connecting device of this embodiment is similar to the connecting device 100 of the first embodiment, and the difference lies in that the main arm member 30*a* of the connecting device of this embodiment further includes a convex block 34*a*. The convex block 34*a* protrudes from a guiding portion 32*a*. Optionally, the convex block 34*a* is a spherical protrusion. Since the spherical protrusion allows the mounting base to rotate by a certain angle relative to the main arm member 30*a*, the glass is allowed to perform a certain degree of movement when the glass is subjected to a high wind load. In addition, the spherical protrusion increases the rotation of the mounting base and helps dissipate energy into the connecting rod with better ductility, thereby providing reduced impact resistance on glass.

Embodiment 3

Figure 6:
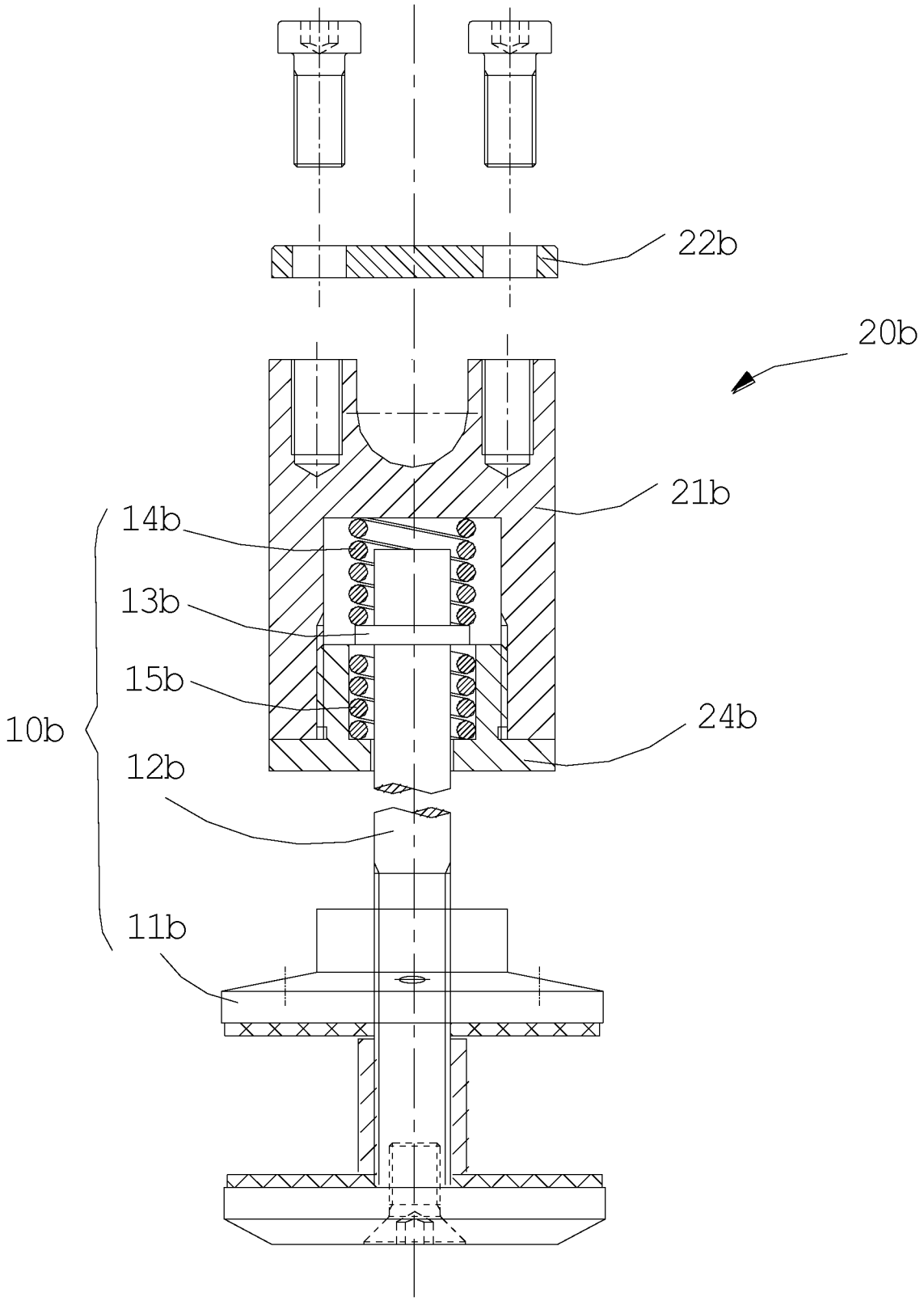
FIG. 6 is a schematic view of a clamping mechanism and a transverse arm mechanism in a connecting device according to a third embodiment of the present disclosure.
Figure 7:
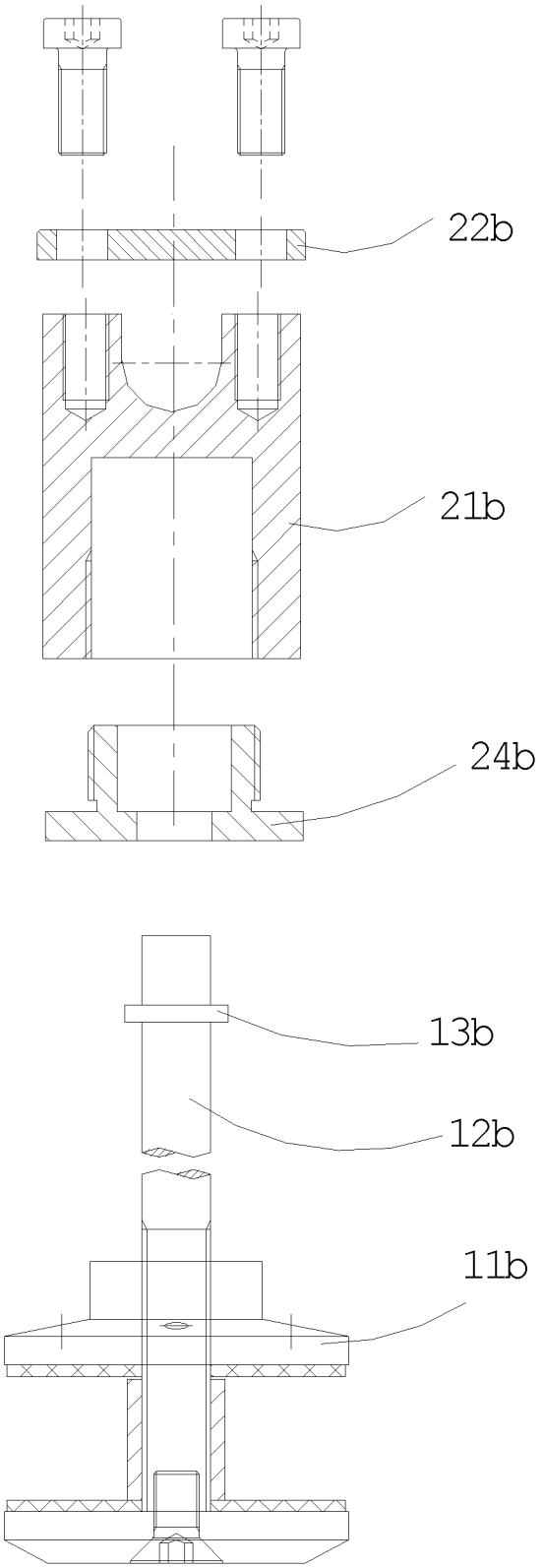
FIG. 7 is a schematic view of the clamping mechanism and the transverse arm mechanism in the connecting device as shown in FIG. 6, where a first elastic member and a second elastic member are not shown.
Figure 8:
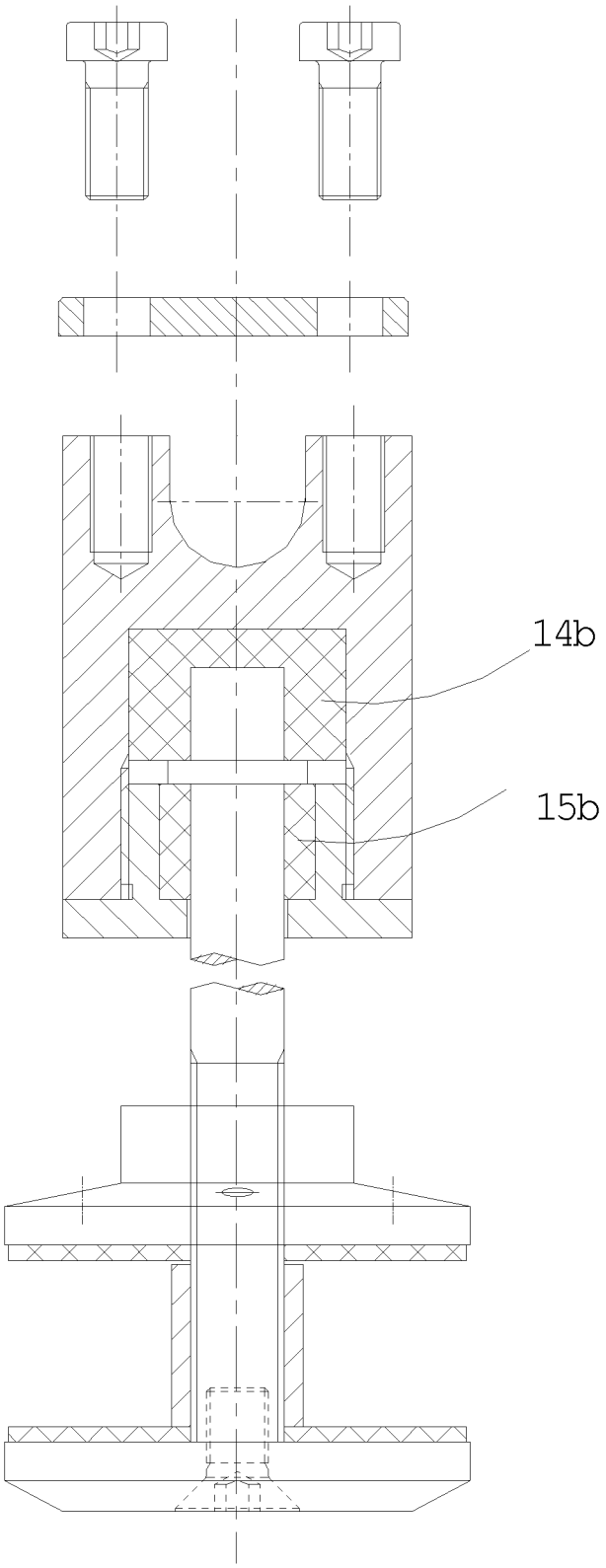
FIG. 8 is a schematic view of the first elastic member and the second elastic member as rubber pads in the connecting device as shown in FIG. 6.

Referring to FIGS. 6 and 7, it shows a connecting device according to a third embodiment of the present disclosure. The connecting device of this embodiment is similar to the connecting device 100 of the first embodiment, and the difference lies in that a clamping mechanism 10*b* of the connecting device of this embodiment further includes an abutting block 13*b*, and a first elastic member 14*b* and a second elastic member 15*b* that are sleeved on an end of a fixing member 12*b* away from a clamping block 11*b*. The abutting block 13*b* is connected to the end of the fixing member 12*b* away from the clamping block 11*b*. Both sides of the abutting block 13*b* abut against the first elastic member 14*b* and the second elastic member 15*b*, respectively. Optionally, both of the first elastic member 14*b* and the second elastic member 15*b* are springs. In other embodiments, both of the first elastic member 14*b* and the second elastic member 15*b* are rubber pads, as shown in FIG. 8. A transverse arm mechanism 20*b* of the connecting device according to this embodiment further includes a fixing base 24*b*. The fixing base 24*b* is connected to an end of a mounting base 21*b* away from a positioning member 22*b*. The fixing member 12*b* is inserted into the mounting base 21*b*. One end of the first elastic member 14*b* abuts against the mounting base 21*b*, the other end thereof abuts against the abutting block 13*b*. One end of the second elastic member 15*b* abuts against the mounting base 21*b*, the other end thereof abuts against the abutting block 13*b*. Subjected to the abutting block 13*b*, the first elastic member 14*b* and the second elastic member 15*b*, the fixing member 12*b* is slidably arranged in the mounting base 21*b*. When the length and width of the glass is relatively large, the glass has the largest deflection deformation in the middle portion. Subjected to a wind pressure, the abutting block 13*b* compresses the first elastic member 14*b* to deform and enable the fixing member 12*b* to move, thereby adapting and limiting the deflection deformation of the glass within a certain range, improving the rigidity of the glass and reducing the stress concentration caused by over-positioning.

Embodiment 4

Figure 9:
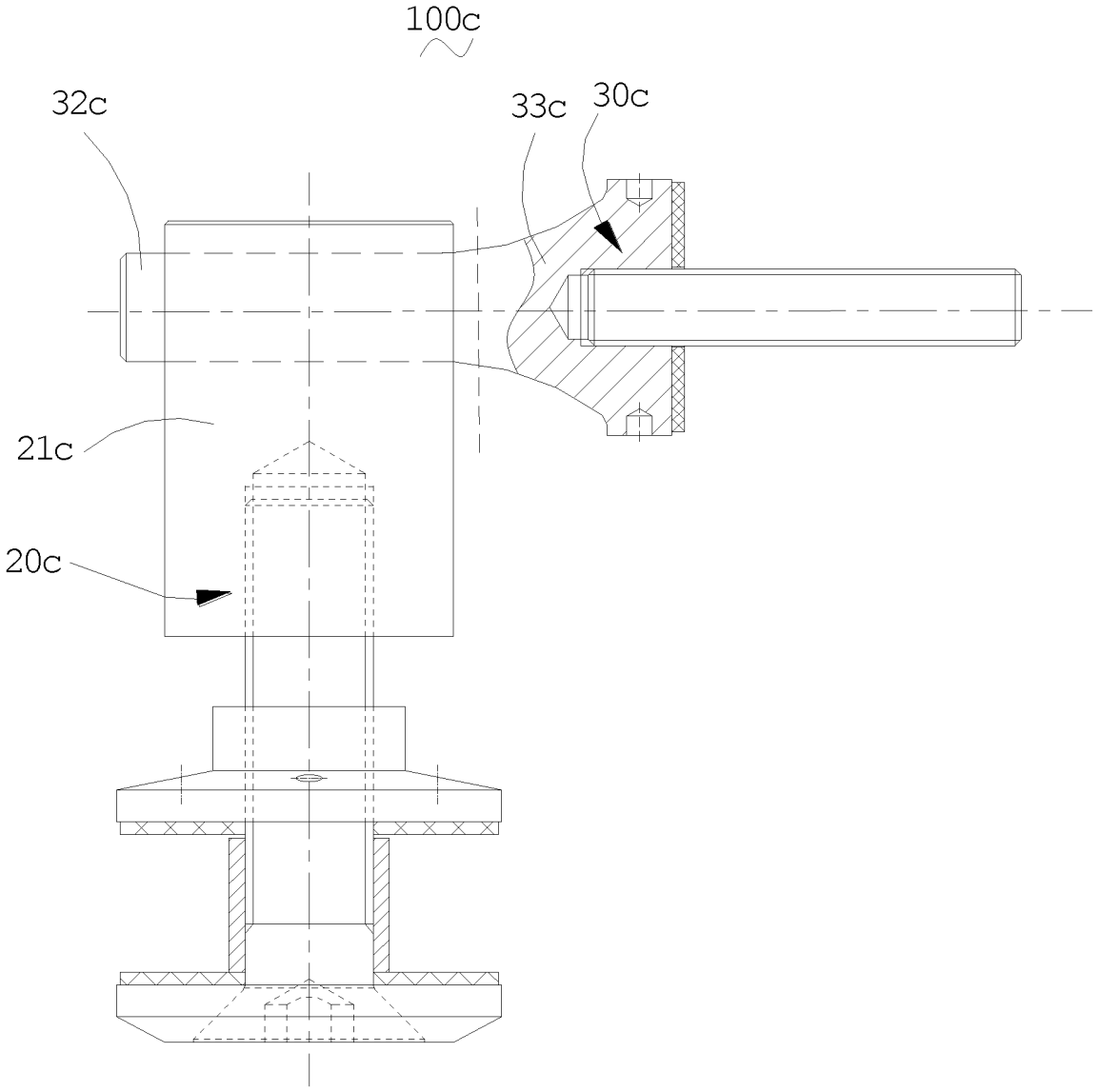
FIG. 9 is a structural schematic view of an assembled state of a connecting device according to a fourth embodiment of the present disclosure.
Figure 10:
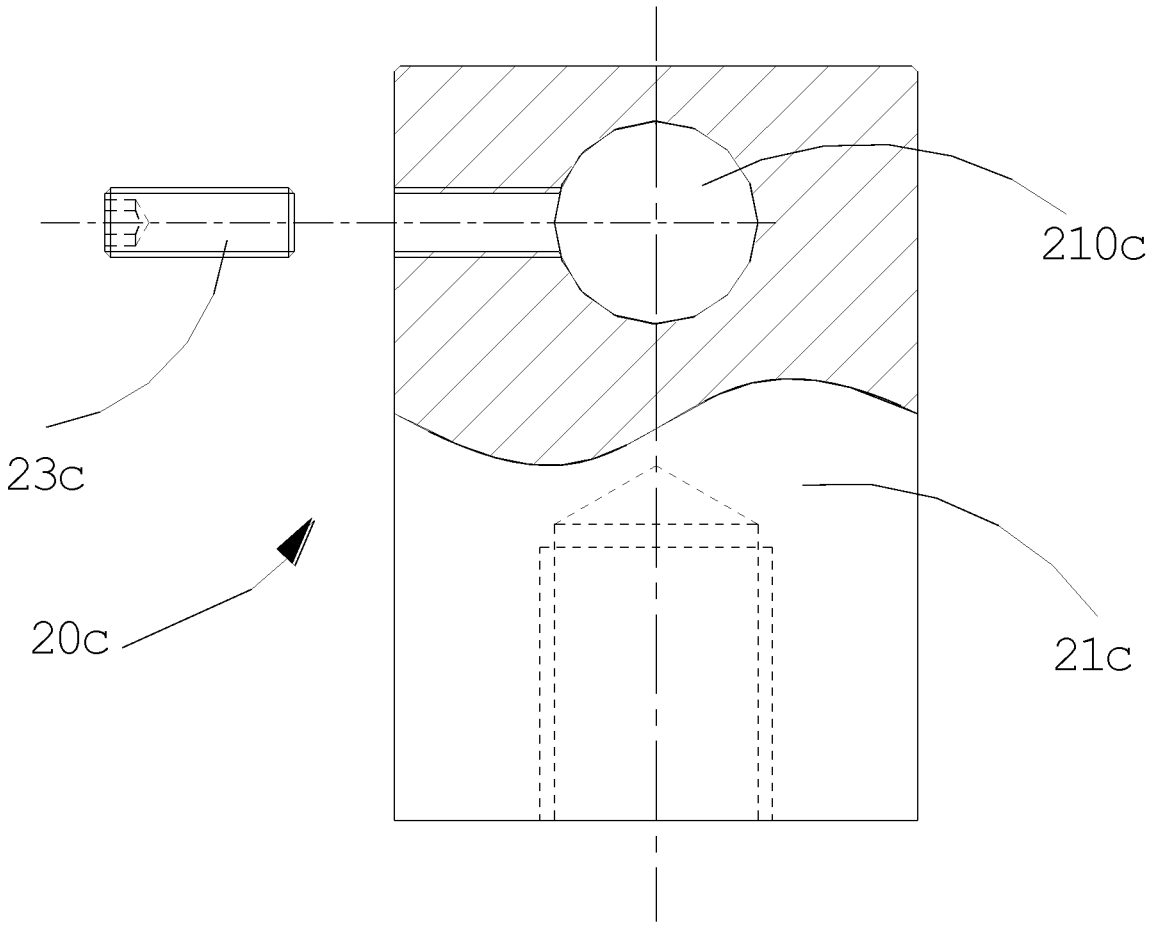
FIG. 10 is an exploded view of the transverse arm mechanism in the connecting device as shown in FIG. 9.
Figure 11:
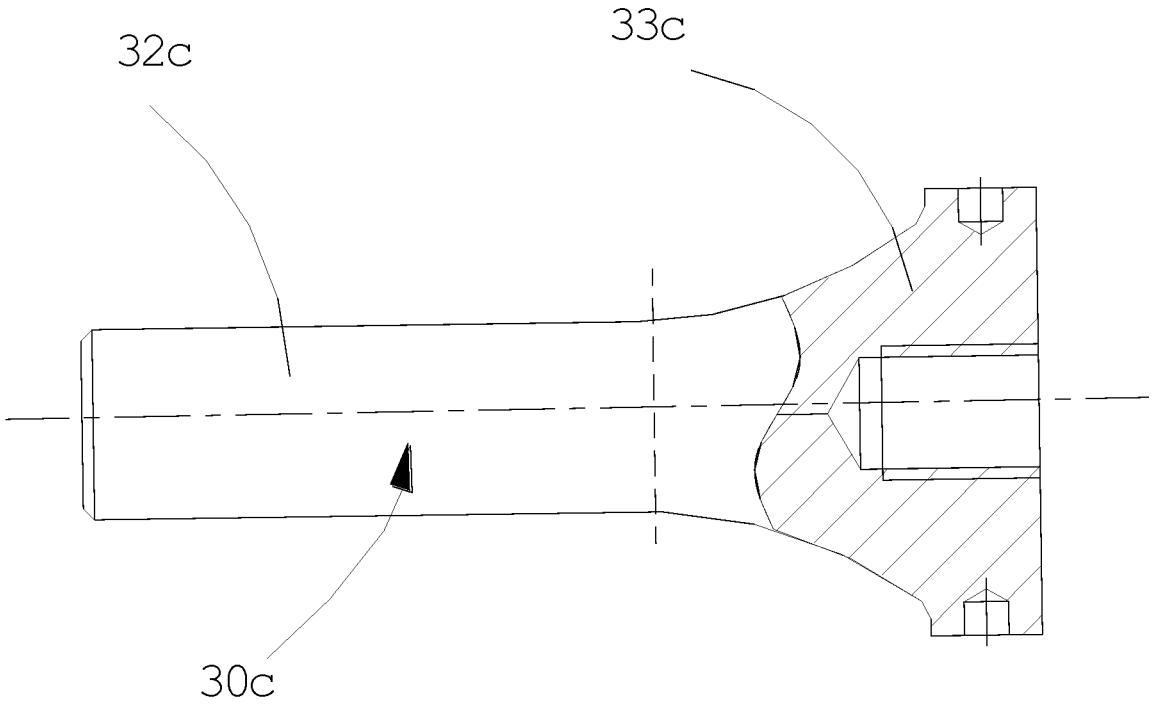
FIG. 11 is a structural schematic view of a main arm member in the connecting device as shown in FIG. 9.

Referring to FIGS. 9 and 11, it shows a connecting device 100*c* according to a fourth embodiment of the present disclosure. The connecting device of this embodiment is similar to the connecting device 100 of the first embodiment, and the difference lies in that a transverse arm mechanism 20*c* of the connecting device 100*c* of this embodiment includes a mounting base 21*c* and a fastening member 23*c*. A main arm member 30*c* extends through the mounting base 21*c*. The fastening member 23*c* is configured to connect the main arm member 30*c* and the mounting base 21*c*. Optionally, the mounting base 21*c* is provided with a through hole 210*c* allowing the main arm member 30*c* to extend through. The fastening member 23*c* extends through one side of the mounting base 21*c* and thus abuts against the main arm member 30*c*. Further, the main arm member 30*c* includes a guiding portion 32*c* and a limiting portion 33*c* that are sequentially connected. The guiding portion 32*c* is slidably arranged in the mounting base 21*c*. The limiting portion 33*c* is connected to the connecting rod. Optionally, the guiding portion 32*c* is a straight rod, and the width of the cross-section of the limiting portion 33*c* gradually increases from one end thereof adjacent to the guiding portion 32*c* to the other end thereof. Moreover, the largest width of the cross-section of the limiting portion 33*c* is larger than the size of the through hole 210*c*, so as to stop the main arm member 30*c* in the mounting base 21*c*.

Embodiment 5

Figure 12:
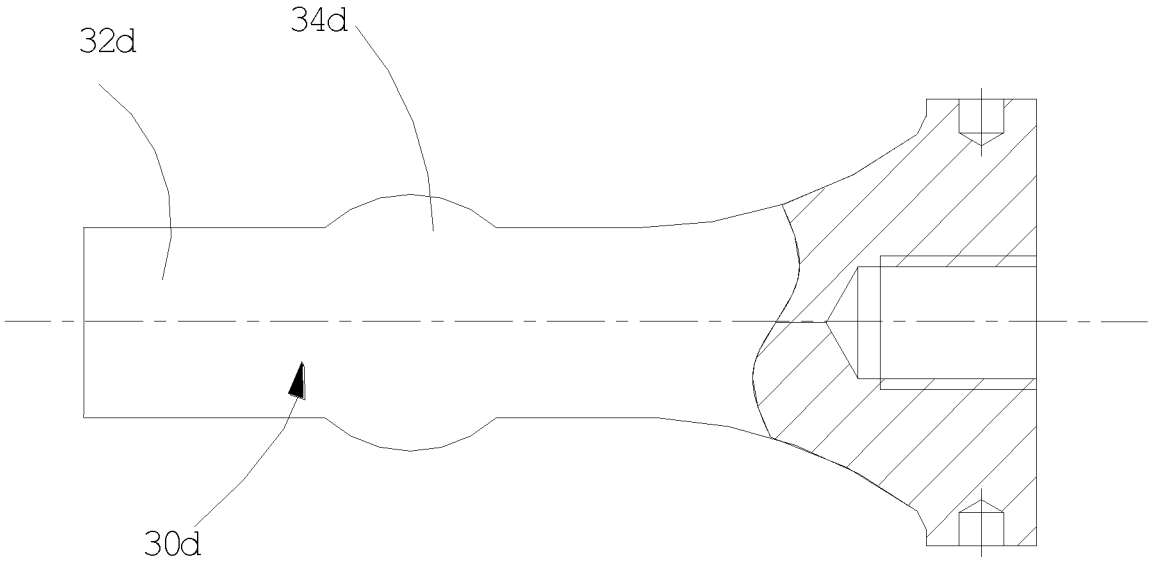
FIG. 12 is a structural schematic view of a main arm member in a connecting device according to a fifth embodiment of the present disclosure.

Referring to FIG. 12, it shows a main arm member 30*d* of a connecting device according to a fifth embodiment of the present disclosure. The connecting device of this embodiment is similar to the connecting device 100*c* of the third embodiment, and the difference lies in that the main arm member 30*d* of the connecting device of this embodiment further includes a convex block 34*d*. The convex block 34*d* protrudes from a guiding portion 32*d*. Optionally, the convex block 34*d* is a spherical protrusion. Since the spherical protrusion allows the mounting base to rotate by a certain angle relative to the main arm member 30*d*, the glass is allowed to perform a certain degree of movement when the glass is subjected to a high wind load. In addition, the spherical protrusion increases the degree of rotation of the mounting base and helps dissipate energy into the connecting rod with better ductility, thereby providing reduced impact resistance on glass.

Embodiment 6

Figure 13:
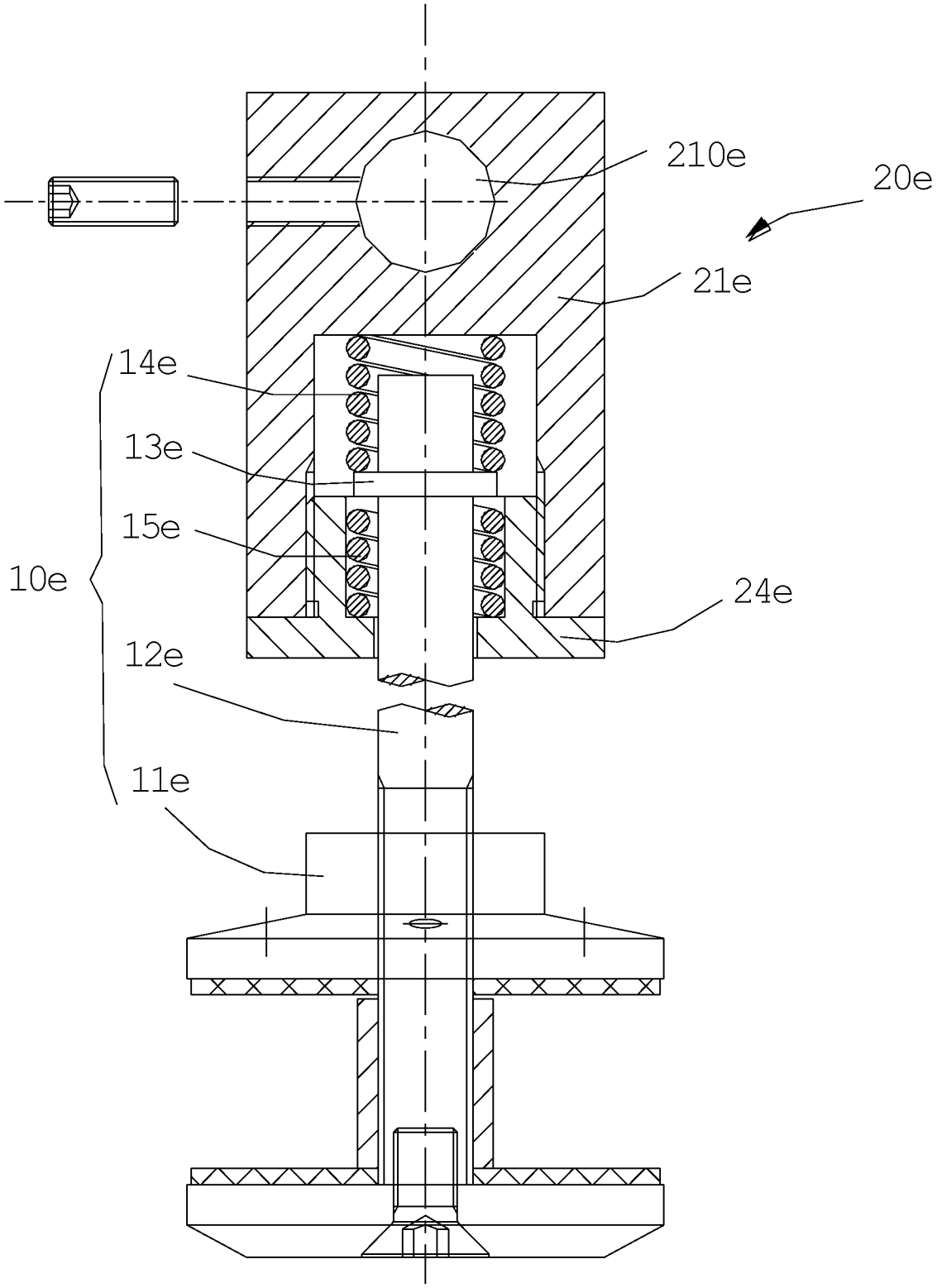
FIG. 13 is a schematic view of a clamping mechanism and a transverse arm mechanism in a connecting device according to a sixth embodiment of the present disclosure.
Figure 14:
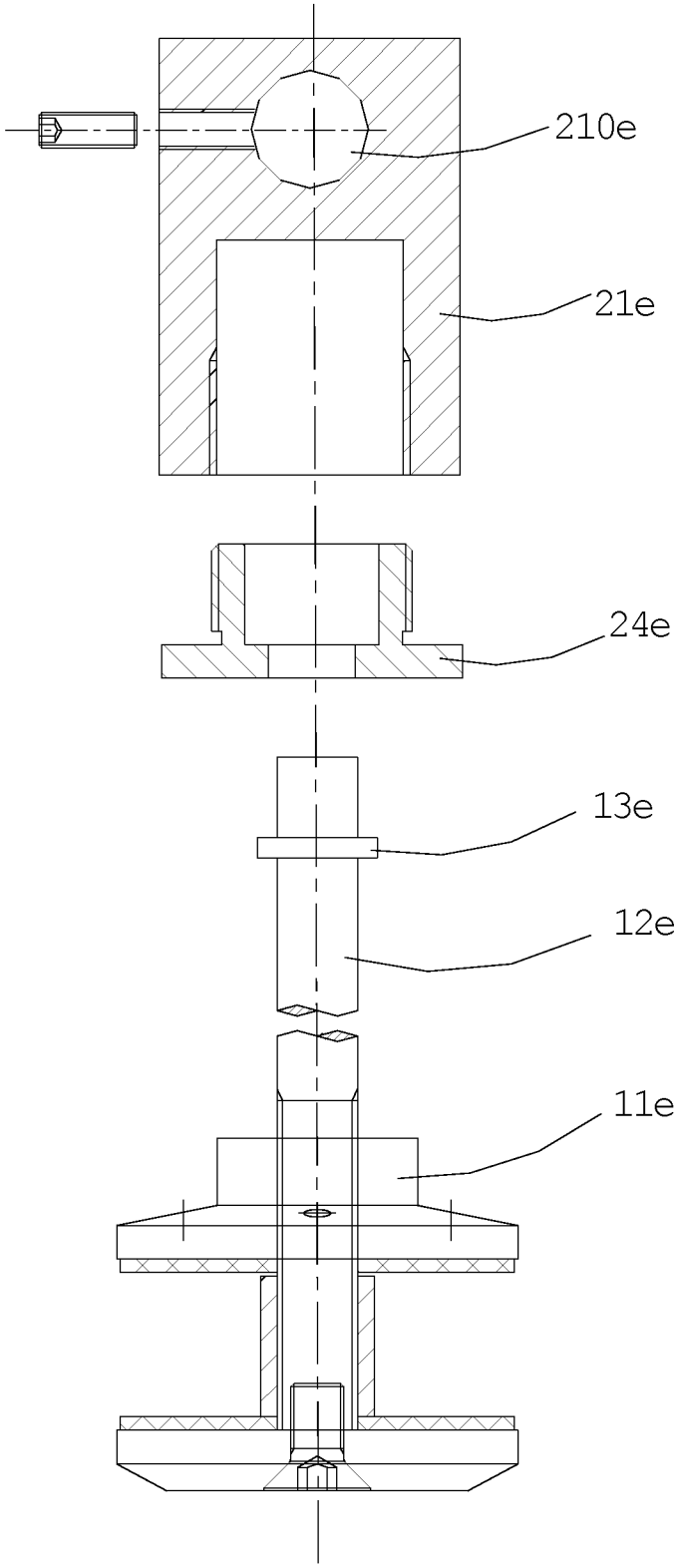
FIG. 14 is a schematic view of the clamping mechanism and the transverse arm mechanism in the connecting device as shown in FIG. 13, where a first elastic member and a second elastic member are not shown.
Figure 15:
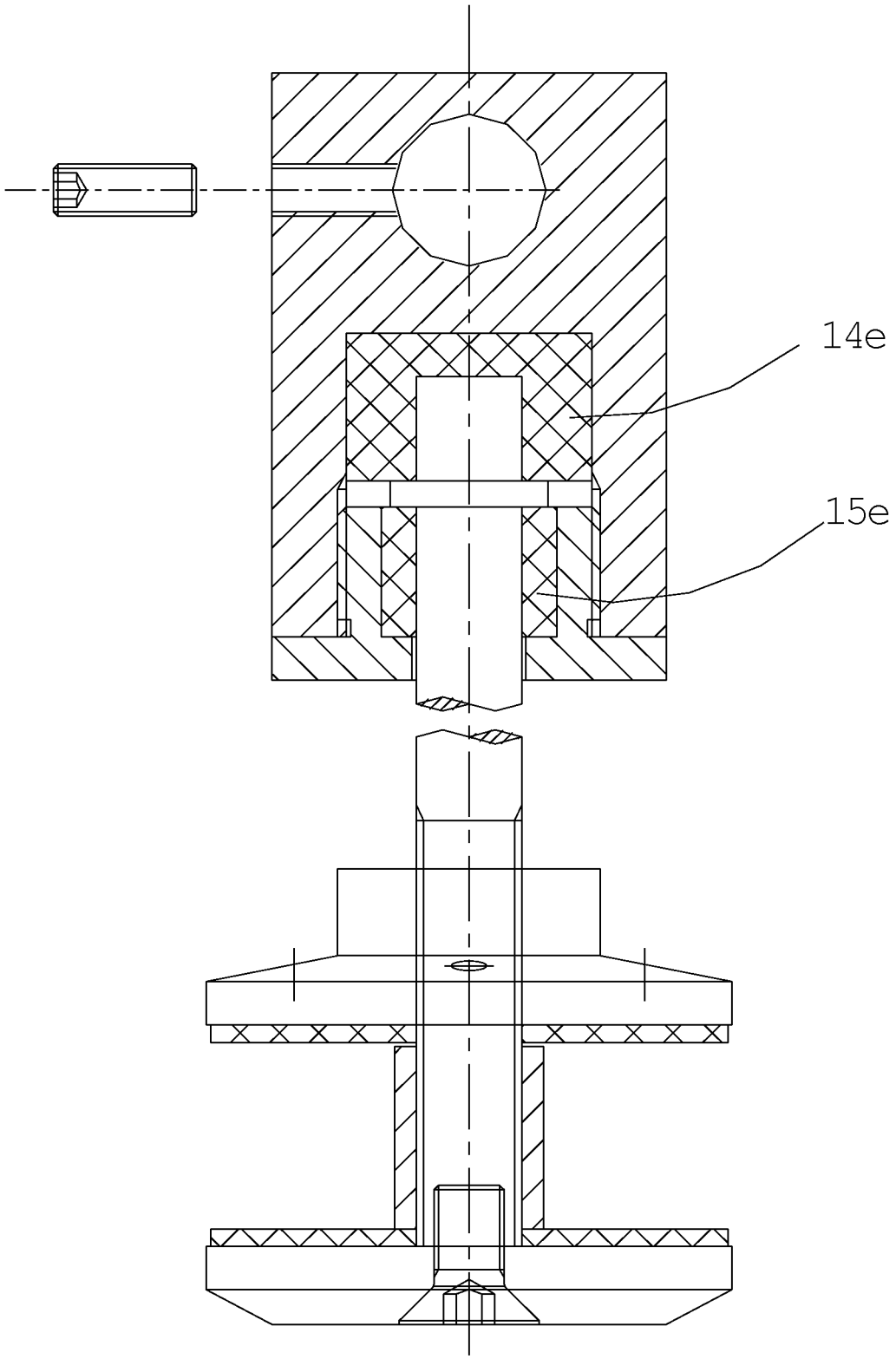
FIG. 15 is a schematic view of the first elastic member and the second elastic member as rubber pads in the connecting device as shown in FIG. 13.

Referring to FIGS. 13 and 14, it shows a connecting device according to a sixth embodiment of the present disclosure. The connecting device of this embodiment is similar to the connecting device 100*c* of the fourth embodiment, and the difference lies in that a clamping mechanism 10*e* of the connecting device of this embodiment further includes an abutting block 13*e*, and a first elastic member 14*e* and a second elastic member 15*e* that are sleeved on an end of a fixing member 12*e* away from a clamping block 11*e*. The abutting block 13*e* is connected to the end of the fixing member 12*e* away from the clamping block 11*e*. Both sides of the abutting block 13*e* abut against the first elastic member 14*e* and the second elastic member 15*e*, respectively. Optionally, both of the first elastic member 14*e* and the second elastic member 15*e* are springs. In other embodiments, both of the first elastic member 14*e* and the second elastic member 15*e* are rubber pads, as shown in FIG. 15. A transverse arm mechanism 20*e* of the connecting device according to this embodiment further includes a fixing base 24*e*. The fixing base 24*e* is connected to an end of a mounting base 21*e* away from a through hole 210*e*. The fixing member 12*e* is inserted into the mounting base 21*e*. One end of the first elastic member 14*e* abuts against the mounting base 21*e*, the other end thereof abuts against the abutting block 13*e*. Subjected to the abutting block 13*e*, the first elastic member 14*e* and the second elastic member 15*e*, the fixing member 12*e* is slidably arranged in the mounting base 21*e*. When the length and width of the glass is relatively large, the glass has the largest deflection deformation in the middle portion. Subjected to a wind pressure, the abutting block 13*e* compresses the first elastic member 14*e* to deform and enable the fixing member 12*e* to move, thereby adapting and limiting the deflection deformation of the glass within a certain range, improving the rigidity of the glass and reducing the stress concentration caused by over-positioning.

Each the technical features of the embodiments described above can be arbitrarily combined. In order to simplify the description, all possible combinations of each technical features in the above embodiments have not been described. However, as long as there is no contradiction in the combination of these technical features, it should be considered as that all of them fall within the scope recorded in this specification.

The above described embodiments only present several implementation manners of the present disclosure, and descriptions thereof are more specific and detailed, but they cannot be understood as limiting the scope of the application patent. It should be noted that, to those of ordinary skill in the art, several modifications and improvements can be made without departing from the concept of the present disclosure, which all fall within the protection scope of the present disclosure. Therefore, the protection scope of this application patent shall be subject to the appended claims.

What is claimed is:

1. A connecting device for securing a glass panel of a curtain wall comprising a clamping mechanism, a transverse arm mechanism, a main arm member, and a connecting mechanism that are sequentially connected, wherein the clamping mechanism comprises a clamping block and a fixing member, the transverse arm mechanism comprises a mounting base, a positioning member, and a fastening member, the fixing member connects the clamping block and the mounting base, the positioning member is connected to one end of the mounting base away from the clamping mechanism, the fastening member connects the positioning member and the mounting base, the main arm member extends through the mounting base, the connecting mechanism is provided with a connecting rod connected to the main arm member.

2. The connecting device for securing a glass panel of a curtain wall according to claim 1, wherein the main arm member comprises a latching portion, a guiding portion, and a limiting portion that are sequentially connected, the latching portion protrudes from the guiding portion, the guiding portion is slidably arranged in the mounting base, and the limiting portion is connected to the connecting rod.

3. The connecting device for securing a glass panel of a curtain wall according to claim 2, wherein a width of a cross-section of the limiting portion gradually increases from one end thereof adjacent to the guiding portion to the other end thereof.

4. The connecting device for securing a glass panel of a curtain wall according to claim 2, wherein the main arm member further comprises a convex block protruding from the guiding portion.

5. The connecting device for securing a glass panel of a curtain wall according to claim 1, wherein the clamping block comprises a first clamping portion, a second clamping portion, and a connecting portion connecting the first clamping portion and the second clamping portion, the first clamping portion cooperates with the second clamping portion to clamp a glass.

6. The connecting device for securing a glass panel of a curtain wall according to claim 1, wherein the clamping mechanism further comprises an abutting block, and a first elastic member and a second elastic member that are sleeved on an end of the fixing member away from the clamping block, both sides of the abutting block abut against the first elastic member and the second elastic member, respectively.

7. A connecting device for securing a glass panel of a curtain wall, comprising a clamping mechanism, a transverse arm mechanism, a main arm member, and a connecting mechanism that are sequentially connected, wherein the clamping mechanism comprises a clamping block, a fixing member, and an abutting block, and a first elastic member and a second elastic member that are sleeved on an end of the fixing member away from the clamping block, both sides of the abutting block abut against the first elastic member and the second elastic member, respectively, the transverse arm mechanism comprises a mounting base and a fastening member, the fixing member connects the clamping block and the mounting base, the main arm member extends through the mounting base, the fastening member connects the main arm member and the mounting base, the connecting mechanism is provided with a connecting rod connected to the main arm member.

8. The connecting device for securing a glass panel of a curtain wall according to claim 7, wherein the main arm member comprises a guiding portion and a limiting portion that are sequentially connected, the guiding portion is slidably arranged in the mounting base, and the limiting portion is connected to the connecting rod.

9. The connecting device for securing a glass panel of a curtain wall according to claim 8, wherein the main arm member further comprises a convex block protruding from the guiding portion.

* * * * *